US007814844B2

(12) United States Patent
Haney et al.

(10) Patent No.: US 7,814,844 B2
(45) **Date of Patent: *Oct. 19, 2010**

(54) TABLE WITH EDGE SUPPORT STRUCTURES

(75) Inventors: Thayne Haney, Syracuse, UT (US); L. Curtis Strong, Clearfield, UT (US)

(73) Assignee: Lifetime Products, Inc., Clearfield, UT (US)

( * ) Notice: Subject to any disclaimer, the term of this patent is extended or adjusted under 35 U.S.C. 154(b) by 655 days.

This patent is subject to a terminal disclaimer.

(21) Appl. No.: 11/373,582

(22) Filed: Mar. 9, 2006

(65) Prior Publication Data

US 2006/0236902 A1 Oct. 26, 2006

Related U.S. Application Data

(63) Continuation-in-part of application No. 10/409,273, filed on Apr. 8, 2003, now Pat. No. 7,111,563, and a continuation-in-part of application No. 11/051,933, filed on Feb. 4, 2005, now Pat. No. 7,475,643, which is a continuation-in-part of application No. 29/198,778, filed on Feb. 4, 2004, now Pat. No. Des. 509,386.

(60) Provisional application No. 60/371,486, filed on Apr. 9, 2002, provisional application No. 60/541,639, filed on Feb. 4, 2004, provisional application No. 60/660,061, filed on Mar. 9, 2005.

(51) Int. Cl.
*A47B 3/00* (2006.01)

(52) U.S. Cl. ..... 108/132; 108/129; 108/27

(58) Field of Classification Search ..... 108/132, 108/129, 131, 133, 161, 115, 27; 248/188.6, 248/188.8

See application file for complete search history.

(56) References Cited

U.S. PATENT DOCUMENTS

| | | | | |
|---|---|---|---|---|
| 1,165,991 | A | 12/1915 | Maggs | |
| 2,059,255 | A | 11/1936 | Lassiat | |
| 2,689,158 | A | 9/1954 | Mahr | |
| 3,357,729 | A | 12/1967 | Krueger | |
| 3,635,432 | A | 1/1972 | Hollander | |
| 3,718,306 | A | 2/1973 | Murray | |
| 3,999,490 | A * | 12/1976 | Rocker et al. | 108/27 |
| 4,503,780 | A * | 3/1985 | Apissomian | 108/27 |
| 4,606,170 | A | 8/1986 | Mendenhall | |
| 4,727,816 | A | 3/1988 | Virtue | |

(Continued)

FOREIGN PATENT DOCUMENTS

CA 2450012 5/2000

(Continued)

OTHER PUBLICATIONS

U.S. Appl. No. 11/051,933, filed Feb. 4, 2005, Haney et al.

(Continued)

*Primary Examiner*—José V Chen
(74) *Attorney, Agent, or Firm*—Workman Nydegger

(57) ABSTRACT

A table may include a table top that is constructed from blow-molded plastic and the table top may include a generally downwardly extending lip. The lip may include reinforcement portions that are sized and configured to increase the strength, rigidity, resilience and/or flexibility of the lip and/or the table top. The table top may include one or more depressions and the depressions may have different characteristics in different directions. For example, the depressions may have an elongated length and the depressions may have increased strength along its length. Advantageously, the different characteristics of the depressions and/or reinforcement portions may be used to create a table top with increased and/or uniform strength, rigidity, resilience and/or flexibility.

25 Claims, 7 Drawing Sheets

U.S. PATENT DOCUMENTS

| | | | | |
|---|---|---|---|---|
| 4,759,296 | A | 7/1988 | Simpson | |
| 4,924,782 | A | 5/1990 | Nichoaids | |
| 5,014,628 | A | 5/1991 | Roberts | |
| 5,050,583 | A | 9/1991 | Chapek et al. | |
| 5,271,338 | A | 12/1993 | Bonham | |
| 5,311,825 | A | 5/1994 | Bonham | |
| 5,348,384 | A | 9/1994 | Hull et al. | |
| 5,362,063 | A | 11/1994 | Cummings | |
| 5,440,857 | A | 8/1995 | Shanok et al. | |
| 5,496,609 | A | 3/1996 | Michelstein | |
| 5,570,484 | A | 11/1996 | Ogle | |
| 5,623,882 | A | 4/1997 | Price | |
| 5,636,578 | A | 6/1997 | Rizzi | |
| 5,678,380 | A | 10/1997 | Azzar | |
| 5,678,491 | A | 10/1997 | Price et al. | |
| 5,694,865 | A | 12/1997 | Raab | |
| 5,722,746 | A | 3/1998 | Hull et al. | |
| 5,732,637 | A | 3/1998 | Raab | |
| 5,809,901 | A * | 9/1998 | Gutzmer | 108/27 |
| 5,868,081 | A | 2/1999 | Raab | |
| 5,921,623 | A | 7/1999 | Nye et al. | |
| 5,947,037 | A | 9/1999 | Hornberger et al. | |
| 5,983,807 | A | 11/1999 | Tarnay et al. | |
| 6,058,853 | A | 5/2000 | Pinch | |
| 6,058,854 | A | 5/2000 | Tarnay et al. | |
| 6,112,674 | A | 9/2000 | Stanford | |
| 6,214,436 | B1 | 4/2001 | Catta et al. | |
| 6,378,831 | B1 | 4/2002 | Copeland, Jr. | |
| 6,520,094 | B2 | 2/2003 | Wen | |
| 6,615,743 | B2 | 9/2003 | Nien | |
| 6,622,644 | B2 | 9/2003 | Buono | |
| 6,694,897 | B2 | 2/2004 | Lou-Hao | |
| D489,557 | S | 5/2004 | Strong et al. | |
| 6,732,663 | B2 | 5/2004 | Tsai | |
| 6,837,171 | B1 | 1/2005 | Clark | |
| 6,877,441 | B2 | 4/2005 | Zheng | |
| 6,915,748 | B2 | 7/2005 | Stanford | |
| D509,386 | S | 9/2005 | Haney | |
| 7,111,563 | B2 | 9/2006 | Strong | |
| 7,475,643 | B2 | 1/2009 | Haney et al. | |
| 2003/0005864 | A1 | 1/2003 | Wen | |
| 2003/0106474 | A1 | 6/2003 | Buono | |
| 2003/0177962 | A1 | 9/2003 | Stanford | |
| 2003/0213416 | A1 | 11/2003 | Strong et al. | |
| 2003/0233967 | A1 | 12/2003 | Lin | |
| 2004/0031422 | A1 | 2/2004 | Wong | |
| 2005/0274304 | A1 | 12/2005 | Strong | |
| 2005/0279260 | A1 | 12/2005 | Stanford | |
| 2006/0000394 | A1 | 1/2006 | Stanford | |
| 2006/0236902 | A1 | 10/2006 | Haney et al. | |
| 2008/0026881 | A1 | 1/2008 | Stanford et al. | |

FOREIGN PATENT DOCUMENTS

| | | |
|---|---|---|
| JP | 7-158263 | 6/1995 |
| JP | 2001-38796 | 2/2001 |

OTHER PUBLICATIONS

U.S. Appl. No. 29/279,299, filed Apr. 25, 2007, Van Nimwegen et al.
U.S. Appl. No. 12/351,827, filed Jan. 10, 2009, Haney.
Notice of Allowance dated Sep. 18, 2008 cited in related U.S. Appl. No. 11/051,933.
Office Action dated Apr. 2, 2008, cited in related U.S. Appl. No. 11/051,933.
U.S. Appl. No. 12/110,163, filed Apr. 25, 2008, VanNimwegen.
International Search Report and Written Opinion from International Application No. PCT/US2008/061693, dated Aug. 18, 2008.
International Search Report and Written Opinion from International Application No. PCT/US0228/061693, dated Aug. 20, 2008.
Office Action dated Aug. 2, 2007 from U.S. Appl. No. 11/051,933.
Office Action dated Nov. 9, 2006 from U.S. Appl. No. 10/409,273.
Office Action dated Oct. 21, 2009 from U.S. Appl. No. 12/110,163.
Office Action from related U.S. Appl. No. 12/351,827 dated Apr. 2, 2010.

* cited by examiner

TABLE WITH EDGE SUPPORT STRUCTURES

CROSS-REFERENCE TO RELATED APPLICATIONS

This application claims priority to and the benefit of U.S. provisional patent application Ser. No. 60/660,061, filed Mar. 9, 2005.

This application is a continuation-in-part of U.S. patent application Ser. No. 10/409,273, filed on Apr. 8, 2003, now U.S. Pat. No. 7,111,563; which claims priority to and the benefit of U.S. provisional patent application Ser. No. 60/371,486, filed on Apr. 9, 2002.

This application is a continuation-in-part of U.S. patent application Ser. No. 11/051,933, filed Feb. 4, 2005, now U.S. Pat. No. 7,475,643; which claims priority to and the benefit of U.S. provisional patent application Ser. No. 60/541,639, filed Feb. 4, 2004. U.S. patent application Ser. No. 11/051,933 is also a continuation-in-part of U.S. patent application Ser. No. 10/409,273, filed on Apr. 8, 2003; now U.S. Pat. No. 7,111,563 which claims priority to and the benefit of U.S. provisional patent application Ser. No. 60/371,486, filed on Apr. 9, 2002. In addition, U.S. patent application Ser. No. 11/051,933 filed on Feb. 4, 2005 is a continuation-in-part of U.S. design patent application Ser. No. 29/198,778, filed on Feb. 4, 2004, now U.S. Pat. No. D509,386.

All of these applications are incorporated by reference in their entirety.

BACKGROUND OF THE INVENTION

1. Field of the Invention

The present invention is generally related to tables and, in particular, to tables with table tops constructed from blow-molded plastic.

2. Description of Related Art

Many different types of tables are well known and used for a variety of different purposes. For example, many conventional tables may include legs that are pivotally attached to the table top and the legs may be movable between a use position in which the legs extend outwardly from the table top and a storage position in which the legs are folded against the table top. Large, portable tables with folding legs are often referred to as "banquet tables" and these tables are often used in assembly halls, banquet halls, convention centers, hotels, schools, churches and other locations where large groups of people meet. Because these types of tables are generally portable, the tables may be positioned in an assortment of different configurations and used in a variety of settings. When the banquet tables are no longer needed, the tables can be moved or stored.

Banquet tables are often used by various organizations and groups because they w allow effective and efficient use of space. For example, banquet tables may be used in large multi-purpose areas such as school gymnasiums, meeting halls and hotel conference rooms to allow groups of people to meet. After the meetings are completed, the tables can be folded into the storage position and stowed in a relatively small space. This allows the gymnasiums, meeting halls and conference rooms to be used for other purposes. Thus, banquet tables allow groups and organizations to efficiently use a particular space.

Conventional banquet tables with legs that are foldable between a use position and a storage position may also be used in a variety of other locations. For example, these known tables may provide immediate table space and/or workspace in a house, apartment, garage, tool shed and the like. The foldable legs may allow the tables to be conveniently set up, taken down, stored and transported whenever and wherever the user chooses.

The legs of conventional banquet tables are often attached to the table top by a number of mechanical fasteners such as screws or bolts. Disadvantageously, the mechanical fasteners may create a number of holes in the table top and these holes may decrease the structural integrity of the table top and/or create undesirable stress concentrations in the table top. The holes may also create weakness or failure points that may allow the table to give way and collapse. It is also known to attach the legs to the table top by adhesives such as glue, epoxy resins or other suitable types of bonding agents. The bonding of the legs to the table top, however, may decrease the structural integrity of the table top. Significantly, if the mechanical fasteners or adhesive connection of the legs to the table top fails, then the table may collapse and the table may be very difficult or impossible to fix or repair, especially if the leg attachment portion of the table top is damaged or pulled away from the remaining portion of the table top.

The use of mechanical fasteners to attach the legs to the table top may undesirably increase the number of parts required to construct the table, which may increase the time required to assemble the table. In addition, many conventional tables required the legs to be positioned against the underside of the table top and then attached to the table top by the mechanical fasteners or glue. This may increase the difficulty of the manufacturing process because the legs and table top must first be held in the desired positions and then the legs must be fastened to the table top. In particular, if mechanical fasteners are used to attach the legs to the table top, mating surfaces such as holes in the legs and corresponding threaded openings in the table top must be carefully aligned before the legs can be attached to the table top. Accordingly, many conventional tables require one or more persons to hold the legs and table top in the desired locations, and another person to fasten the legs to the table top. This process is undesirably time consuming and labor intensive. Alternatively, a single person may be used to attach the legs to the table top, but this process is difficult to perform rapidly and without any errors.

Many conventional banquet tables are also relatively heavy and difficult to move because of their large size. For example, conventional banquet tables are often six or eight feet in length and two or three feet in width. In addition, conventional banquet tables may have a round configuration with a diameter of five or six feet. The large size and weight of these known tables may require two or more people to move the table.

It is known to construct banquet tables with table tops constructed from plastic or other lightweight materials in an attempt to decrease the weight of the tables. Many of these lighter-weight tables, however, lack the strength and sturdiness of the heavier-weight tables. Thus, many lighter-weight tables require complex support mechanisms and one or more support braces to increase the strength and sturdiness of the table, which may undesirably increase the weight and complexity of the tables.

Conventional banquet tables with table tops constructed from plastic may be easily damaged. For example, if the table is inadvertently knocked over or dropped while being carried, then a portion of the table top may be damaged. These types of table tops may also be damaged during shipping and/or storage, especially if the tables are stored on their sides or edges.

In addition, conventional banquet tables are frequently dragged or rolled on the ground when being moved, especially if being moved by only one person. For example, a person may roll a banquet table with a round table top on its outer edge when its legs are in the collapsed position. Undesirably, this may damage the outer edge of the table top. In particular, the edge of the table top may be damaged if the table is rolled down stairs, over curbs or other uneven surface. If the outer edge of the table top is damaged or crushed, it may be difficult or impossible to repair or replace.

BRIEF SUMMARY OF EMBODIMENTS OF THE INVENTION

A need therefore exists for a table that eliminates or diminishes the above-described disadvantages and problems.

One aspect is a table that may include a table top and legs. The legs may be movable between a first position in which the legs extend away from the table top to allow the table to be used and a second position in which the legs are positioned near the table top for storage.

Another aspect is a table that may include a table top that is constructed from plastic. Desirably, the table top may be constructed from blow-molded plastic and the table top may be lightweight.

Yet another aspect is a table that may include a table top with one or more depressions, "tack-offs" or "kiss-offs." The depressions, which preferably extend from one surface towards another surface, are desirably sized and configured to increase the strength and/or rigidity of the table top.

Still another aspect is a table that may include a table top with a generally downwardly extending lip. The lip may be positioned at or proximate an outer edge of the table top and the lip may include one or more reinforcement portions, such as serrations, notches, ribs, and/or struts, which are preferably sized and configured to increase the strength, rigidity, resilience and/or flexibility of the lip. In particular, the reinforcement portions may increase the strength, rigidity, resilience and/or flexibility of the inner and/or outer surfaces of the lip. In addition, the reinforcement portions may be formed in the lower, inner and/or outer portions of the lip. The reinforcement portions may also include one or more raised, lowered and/or even surfaces. This may allow, for example, different surfaces to be disposed at different distances. Additionally, one surface may be used to reinforce and/or support another surface, if desired. Further, one or more depressions, "tack-offs" or "kiss-offs" may be disposed at least partially within the reinforcement portions formed in the lip.

A further aspect is a table that may include a table top with one or more reinforcement portions formed in the table top. For example, the reinforcement portions may be formed in the lower surface of the table top and the reinforcement portions may be generally aligned with the reinforcement portions in the lip. The reinforcement portions in the lower surface of the table top may be sized and configured to increase the strength, rigidity, resilience and/or flexibility of the table top. If desired, one or more depressions, "tack-offs" or "kiss-offs" may be disposed at least partially within the reinforcement portions formed in the table top.

A still further aspect is a table that may include a table top with reinforcement portions located on opposing surfaces. The reinforcement portions may be formed, for example, in the table top and/or lip. The reinforcement portions may extend away from the lip and toward the center portion of the table top, if desired. The reinforcement portions may also extend toward each other, if desired.

Another aspect is a table that may include a table top with one or more reinforcement portions which include raised and/or lowered portions. For example, raised portions may extend outwardly from a surface and the lower portions may extend inwardly from a surface. In particular, the raised portions may include projections, protrusions, extensions and the like; while the lowered portions may include channels, trough, grooves and the like. These raised and/or lowered portions may be formed, for example, in the lower portion of the table top and/or lip. For instance, these raised and/or lowered portions may be formed in the lower surface of the table top and aligned with reinforcement portions formed in the lip. These raised and/or lowered portions may also extend away from the lip and toward a center portion of the table top. Advantageously, if desired, one or more depressions, "tack-offs" or "kiss-offs" may be disposed at least partially within the raised and/or lowered portions.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards support structures for edges of a table top. The principles of the present invention, however, are not limited to support structures for edges of a table top. It will be understood that, in light of the present disclosure, the support structures disclosed herein can be successfully used in connection with other portions of the table top and other types of suitable structures.

Additionally, to assist in the description of the support structures for edges of the table top, words such as top, bottom, front, rear, right and left may be used to describe the accompanying figures, which are not necessarily drawn to scale. It will be appreciated, however, that the support structures can be located in a variety of desired positions—including various angles, sideways and even upside down. A detailed description of the table with edge support structures now follows.

Figure 1:
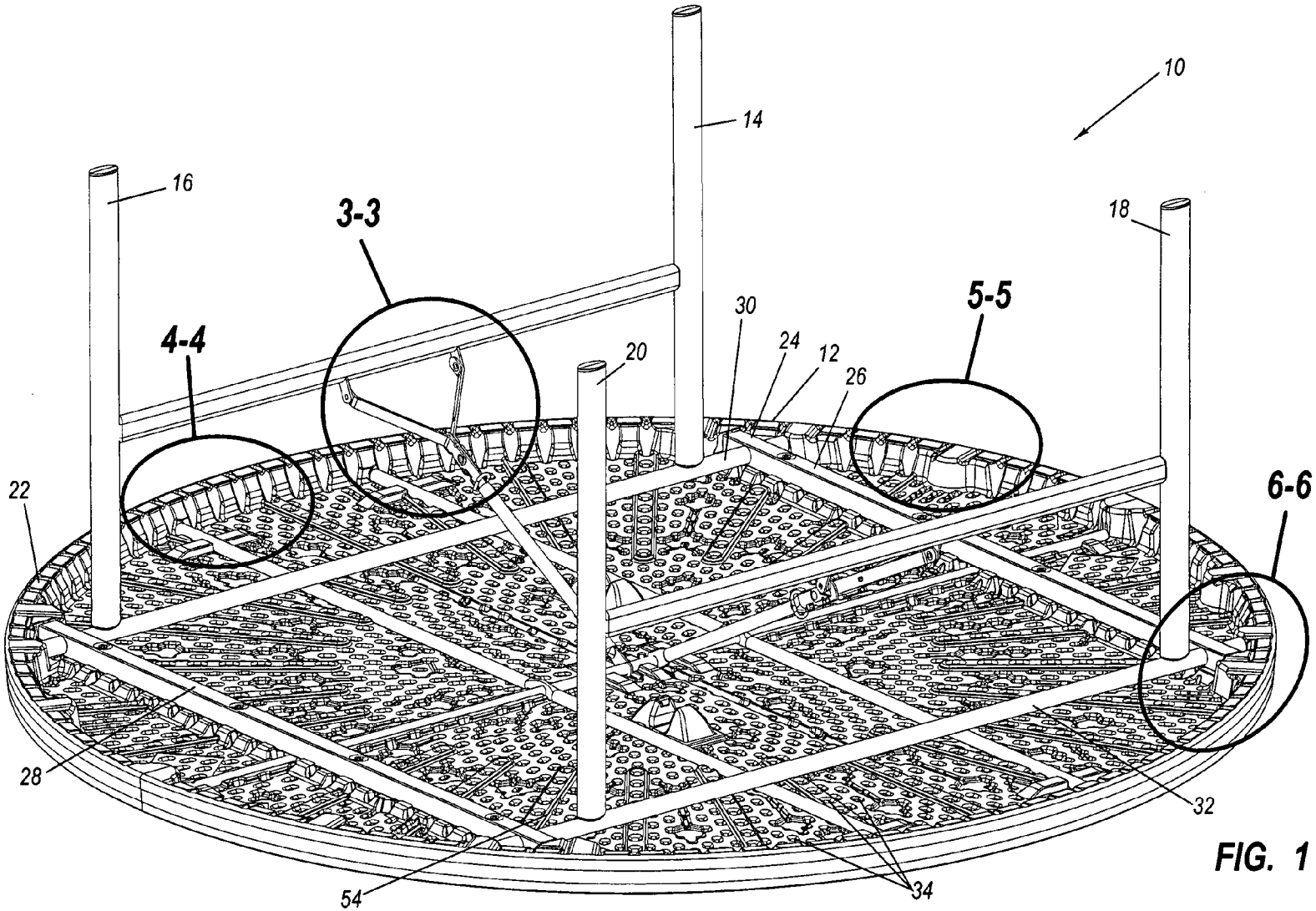
FIG. 1 is a perspective view of an exemplary table, illustrating exemplary legs in an extended or use position.
Figure 2:
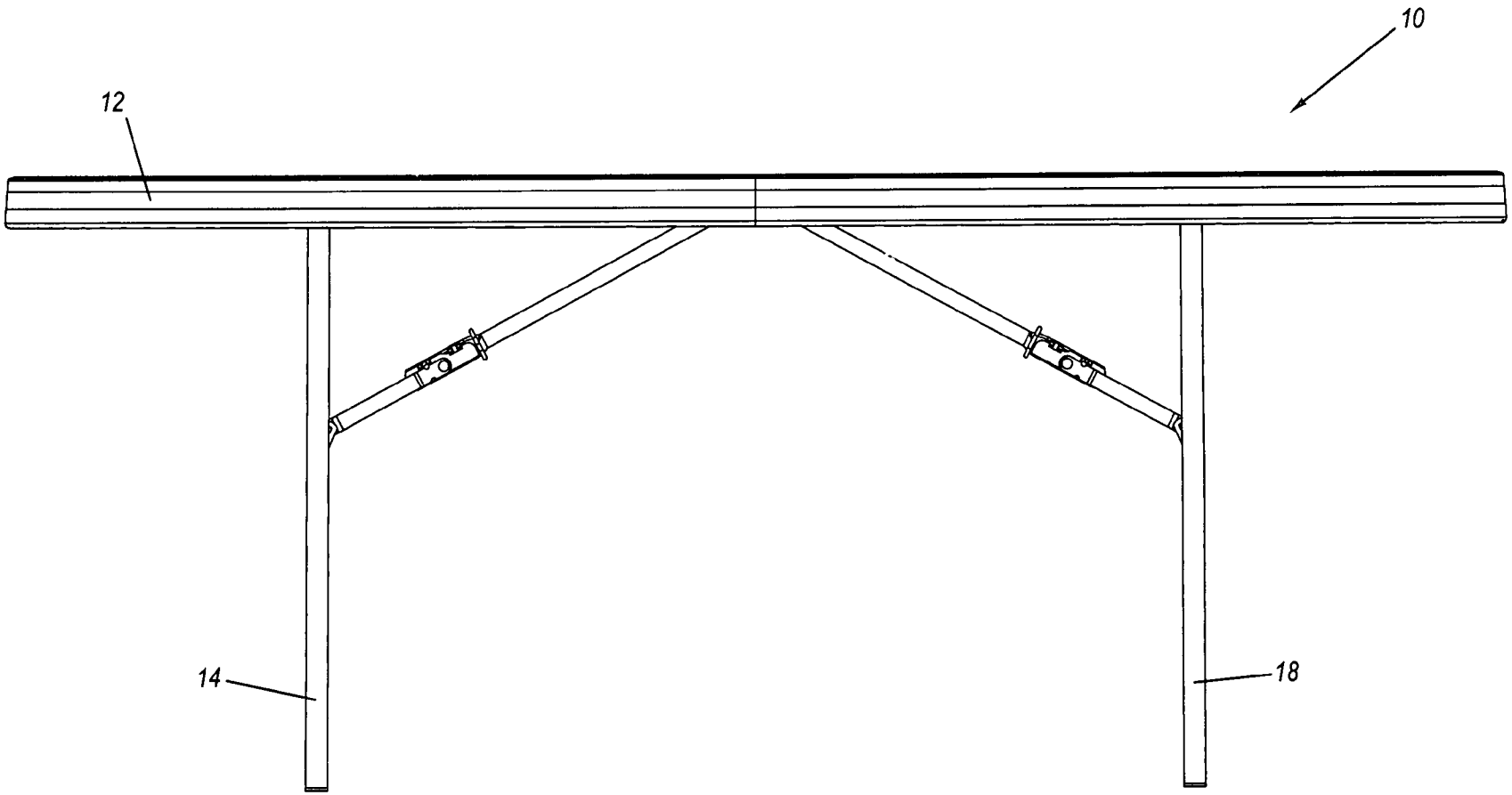
FIG. 2 is a side view of the table shown in FIG. 1.
Figure 3:
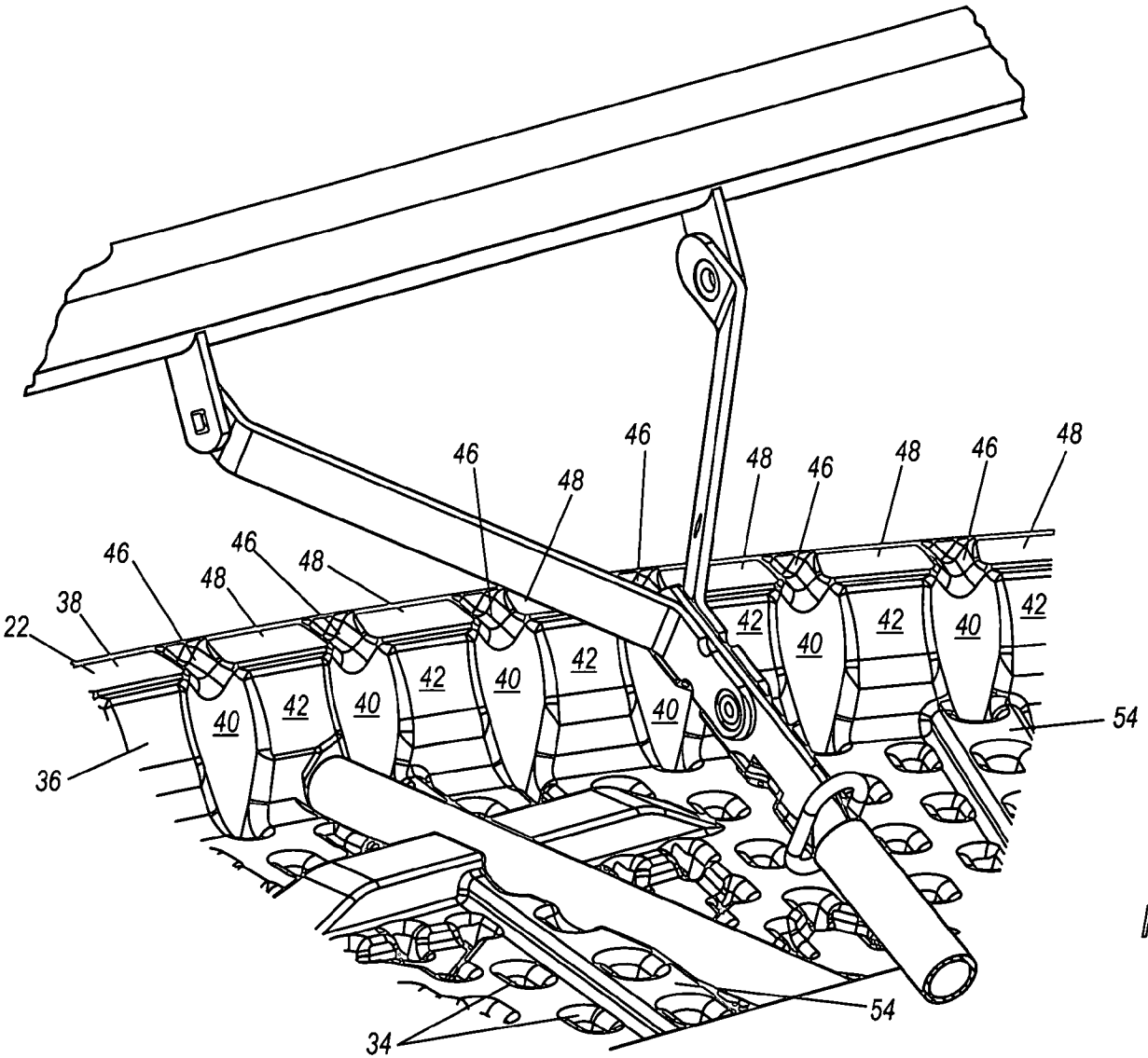
FIG. 3 is an enlarged view of a portion of the table shown in FIG. 1.
Figure 4:
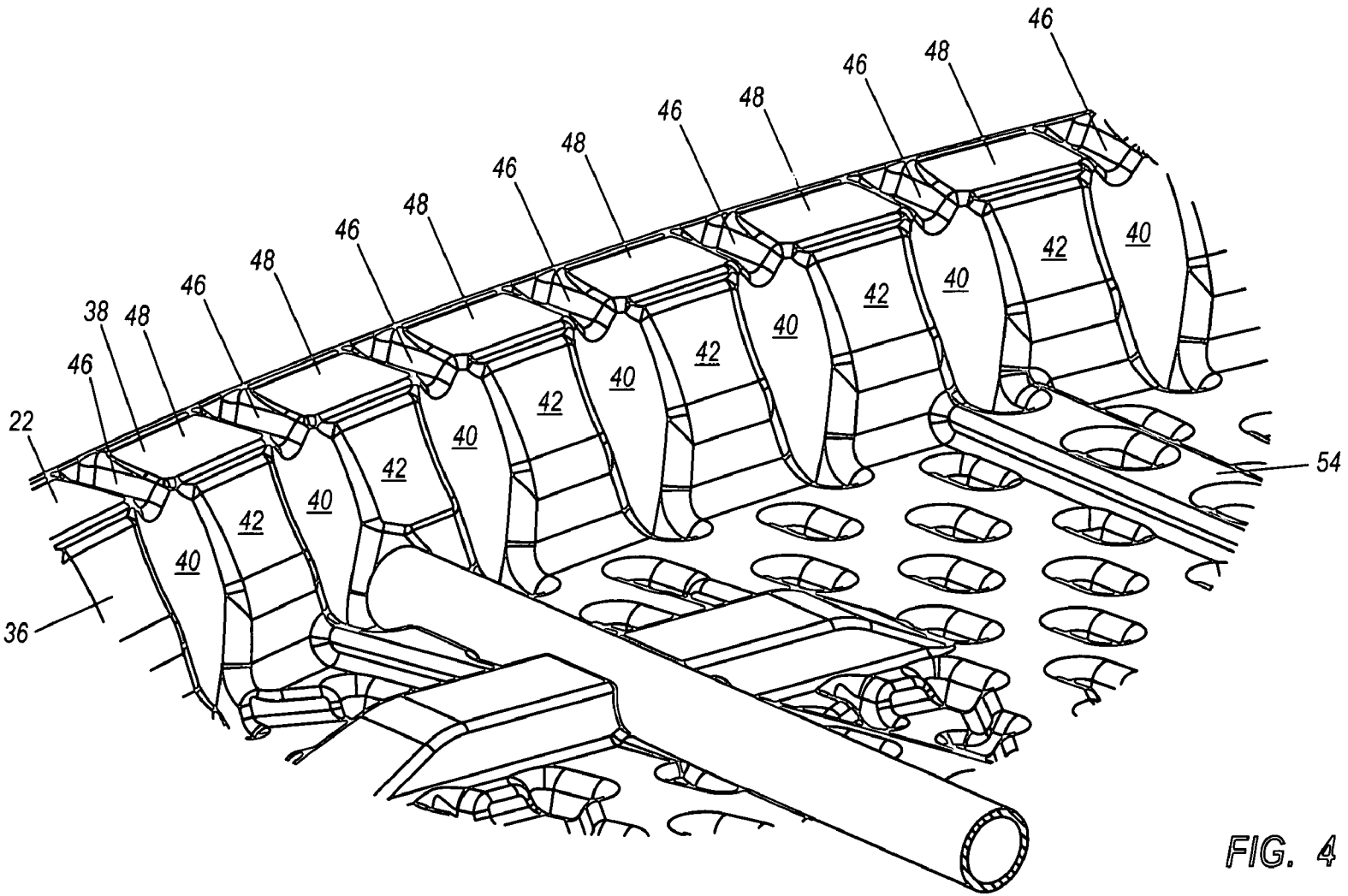
FIG. 4 is an enlarged view of another portion of the table shown in FIG. 1.
Figure 5:
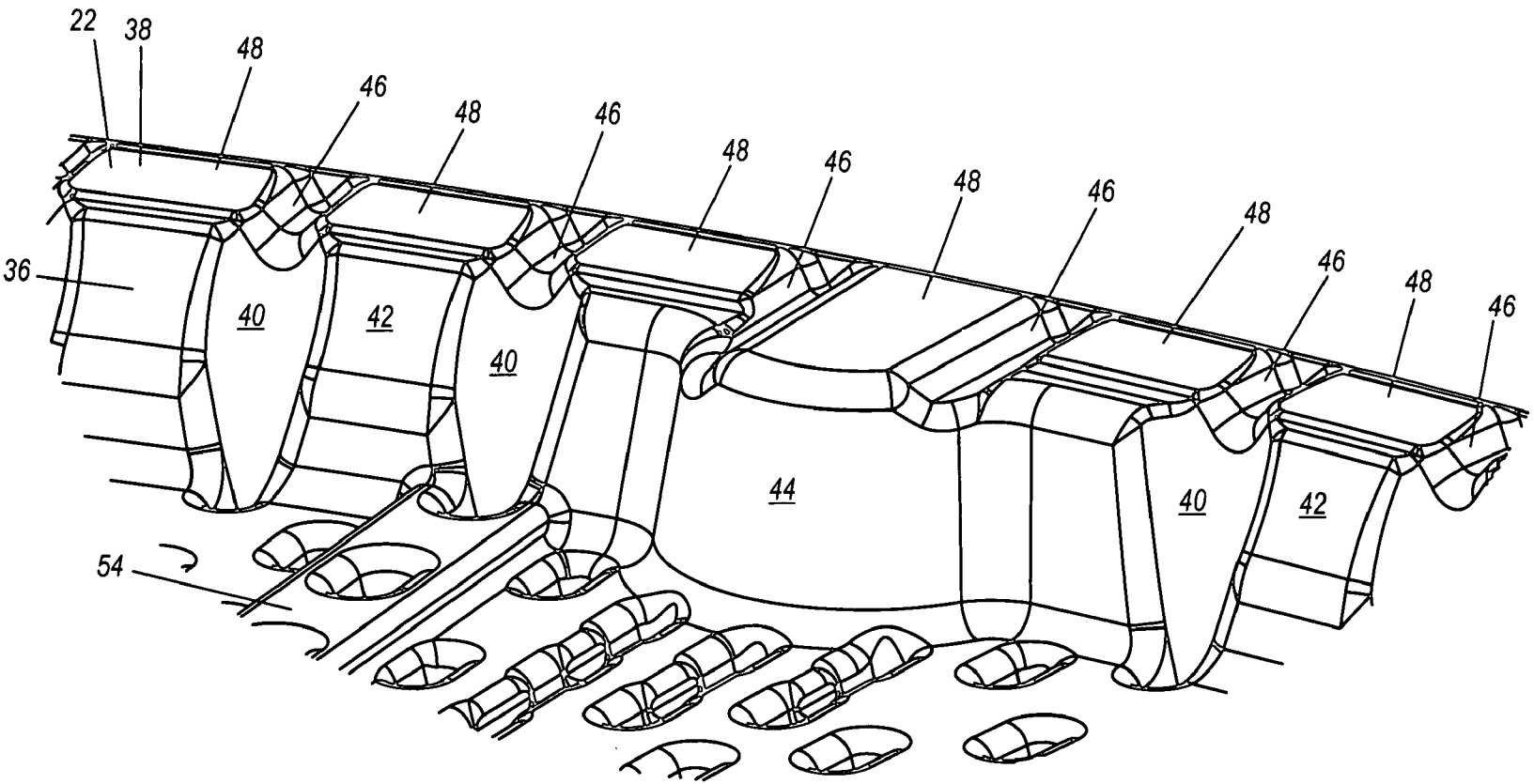
FIG. 5 is an enlarged view of yet another portion of the table shown in FIG. 1.

As shown in FIGS. 1 and 2, a table 10 may include a table top 12 and one or more legs, such as legs 14, 16, 18, 20. The legs 14, 16, 18, 20 are preferably movable between a first position in which the legs extend away from the table top 12 to allow the table 10 to be used and a second position in which the legs are positioned near the table top for storage. Advantageously, the table top 12 and legs 14, 16, 18, 20 may create a strong, sturdy and secure table 10 that can be used to support a wide variety of objects and the table can be used for many different purposes.

The legs 14, 16, 18, 20 may be moved into a storage position to allow the table 10 to be more easily transported or shipped. The legs 14, 16, 18, 20 may at least partially disposed within recesses or channels in the lower portion of the table top 12 to allow the height of the table 10 in the storage position to be decreased. This may also allow the tables 10 to be more easily stacked, shipped and transported. The legs 14, 16, 18, 20 may also have an oval or other non-circular configuration to further decrease the height of the table in the storage position. It will be appreciated, however, that the legs 14, 16, 18, 20 could have any suitable size and configuration, and the legs do not have to be disposed within recesses or channels in the table top 12.

The legs 14, 16, 18, 20 may also be offset, which may allow legs with a longer length to be folded into the storage position. If desired, the length of the legs may be adjustable. When the legs 14, 16, 18, 20 are in the storage position, the legs preferably do not extend beyond a plane generally aligned with a lower portion of a lip 22 of the table top 12, which may facilitate stacking and/or storage of the table 10. In greater detail, when the legs 14, 16, 18, 20 are in the storage position, the legs may be generally positioned between the underneath portion of the table top 12 and a lower portion of the lip 22 to facilitate stacking and/or storage. The legs 14, 16, 18, 20, however, could extend beyond the lower portion of the lip 22 or be disposed in other suitable positions in the collapsed position, if desired.

The table 10 may include a frame 24 that may be used to connect the legs 14, 16, 18, 20 to the table top 12. For example, the frame 24 may include a pair of rails 26, 28 connected to the table top 12. The legs 14, 16, 18, 20 may be connected to the rails 26, 28 by cross members 30, 32. The cross members 30, 32 may be pivotally connected to the rails 26, 28 or the legs 14, 16, 18, 20 may be pivotally connected to the cross members, if desired, which may allow the legs to pivot between the first position in which the legs extend away from the table top 12 and the second position in which the legs are positioned proximate the table top.

The table 10 may be easily assembled and/or disassembled because it preferably does not include any heavy or complex mechanisms to attach the legs to the table top. For example, the frame 24 may be attached to the table top by a snap, friction or interference fit. Specifically, the side rails 26, 28 may be connected to frame mounting portions that are integrally formed in the table top 12. Fasteners, adhesives and the like may also be used to attach the frame 24 to the table top 12.

The table 10 may also be quickly and easily manufactured. For example, the frame 24 may be connected to the table top 12 by a snap, friction or interference fit. The frame 24 may also be connected to the table top 12 by fasteners, adhesives and the like. Because the frame 24 may be simply and easily connected to the table top 12, fewer workers and/or time may be required to assemble the table 10. Further, the straight forward design and attachment of the frame 24 to the table top 12 may allow the table 10 to be shipped either assembled or unassembled, and it may allow retailers or consumers to assemble the table if desired.

The table top 12 is preferably constructed from plastic, which may allow a relatively lightweight table 10 to be constructed. Advantageously, the lightweight table 10 may be easier to move, ship and store. In particular, the table top 12 is preferably constructed from blow-molded plastic, which may allow a strong and lightweight table top to be formed. The blow-molded plastic table top 12 may also be easily formed into any desired configuration, shape, size and design depending, for example, upon the intended use and/or configuration of the table 10. In addition, the blow-molded plastic table top 12 may be generally weather resistant and temperature insensitive, which may allow the table 10 to be used in a wide variety of locations and environments. The blow-molded plastic table top 12 may also be durable and long-lasting because it generally does not corrode, rust or otherwise deteriorate over time. Further, because the blow-molded plastic table top 12 may be relatively strong, the table 10 may be sized and configured to support a relatively large amount of weight. The blow-molded table top 12 may form a structural member of the table 10, if desired.

Advantageously, the blow-molded plastic table top 12 may be relatively strong because it may include two or more opposing walls or surfaces that are separated by a given distance. Preferably, the opposing walls or surfaces are separated by a generally constant distance, but the walls and surfaces could be separated by any suitable distances. In addition, the table top 12 may be lightweight because the table top 12 may include a hollow interior portion, which may be formed during the blow-molding process.

As shown in FIGS. 1 and 3-6, the table top 12 may include one or more depressions, "tack-offs" or "kiss-offs," such as depressions 34. The depressions 34 preferably extend from one surface towards another surface. The depressions 34 are desirably sized and configured to increase the strength and/or rigidity of the table top 12. For example, the depressions 34 preferably include a wall and an end, and the ends of the depressions may contact or engage the opposing surface, but the ends of the depressions do not have to contact or engage another surface. In addition, the depressions 34 may be formed in the lower surface of the table top 12 so that the depressions are generally not visible, but the depressions may be formed in the top surface and/or any other suitable portions of the table top. For instance, one or more depressions 34 may be formed in the top surface of the table top 12 and one or more depressions may be formed in the lower surface of the table top, and these opposing depressions may be generally aligned. At least a portion of these opposing depressions 34 may contact or engage each other, but the opposing depressions do not have to touch or engage.

Significantly, a table top 12 constructed from blow-molded plastic may be quickly and easily constructed. For example, the blow-molding process may allow the opposing walls, depressions and/or other desired features to be quickly and easily formed in the table top. In addition, the blow-molded plastic table top 12 may be constructed as an integral, one-piece structure to help create a strong and rigid table top, but the table top could also be constructed from two or more pieces that are interconnected.

The table top 12 may be constructed with relatively thin outer walls, which may decrease the amount of plastic required to construct the table top 12. For example, because the opposing walls and depressions may allow a strong and sturdy table top to be constructed, the table top 12 may be constructed with relatively thin outer walls. This may reduce manufacturing costs and the amount of resources required to construct the table top 12. The thin outer walls may also allow the table top 12 to be cooled more quickly during the manufacturing process, which may allow the table tops to be more efficiently manufactured.

Additionally, because the table top 12 may be constructed from blow-molded plastic with thin outer walls, this may allow a table top with reduced weight to be constructed.

Significantly, a lightweight table top may allow a lightweight table to be constructed. Advantageously, the lightweight table may reduce shipping costs and may be easily transported. Additionally, the consumer may appreciate the reduced weight because the table may be more easily moved and/or assembled.

The table top 12 may include one or more features that are integrally formed in the table top as part of a unitary, one-piece structure. Advantageously, this may reduce the number of steps required in the manufacturing process, which may reduce the overall cost of the table. For example, one or more depressions 34 may be integrally formed in the table top during a blow molding process or other suitable manufacturing process.

The depressions 34 may also be disposed in a predetermined pattern, if desired. For example, the depressions 34 may be disposed in a pattern that is intended to help increase the strength of the table top 12 and/or decrease the amount of plastic used to construct the table top. In particular, the depressions 34 may be closely spaced and the ends of the depressions may be sized and configured to support an opposing surface. For instance, the ends of the depressions 34 may contact or be spaced proximate the opposing surface such that the depressions help support the opposing surface. Advantageously, this may allow the opposing surface to be smoother, stronger and/or constructed The depressions 34 may be disposed in a pattern that covers a portion of the table top 12. Preferably, the pattern of depressions 34 covers a substantial portion of the table top 12, but the pattern could cover any desired portion or portions of the table top. Desirably, the locations of the depressions 34 do not vary significantly even when other features are integrally formed in the table top 12. Thus, for example, the depressions 34 are preferably positioned in the same general pattern even around features such as attachment portions, edges and the like. In addition, one or more depressions 34 may be at least partially formed within the various features to maintain the generally consistent pattern of depressions. Significantly, the generally uniform pattern of depressions 34 may allow a table top with generally homogeneous characteristics to be constructed.

As shown in FIGS. 1 and 3-6, the table top 12 preferably has a generally round configuration with a diameter of about five or six feet, but it will be appreciated that the table top 12 may have any suitable shape, size and configuration. In addition, the table top 12 preferably includes a generally downwardly extending lip 22 that is disposed at or proximate an outer edge or perimeter of the table top.

The lip 22 preferably includes one or more reinforcement portions that are sized and configured to increase the strength, rigidity, resilience and/or flexibility of the lip. Advantageously, this may help prevent the lip 22 and/or table top 12 from being damaged when the table 10 is being moved, stored or shipped. In particular, if the lip 22 has increase the strength, rigidity, resilience and/or flexibility, then the table 10 may be shipped and stored in a vertical position and on its edge, or rolled on its edge without damaging the table top 12.

In particular, an inner surface 36 of the lip 22 may include one or more reinforcement portions, such as serrations, notches, ribs, and/or struts, which are preferably sized and configured to increase the strength, rigidity, resilience and/or flexibility of the lip and/or the table top 12. A lower surface 38 of the lip 22 may include one or more reinforcement portions, such as serrations, notches, ribs, and/or struts, which are preferably sized and configured to increase the strength, rigidity and/or flexibility of the lip and/or the table top 12. Other portions of the lip 22 and/or table top 12, as discussed in more detail below, may also include reinforcement portions.

In greater detail, as shown in FIGS. 3-6, the inner surface 36 of the lip 22 may include a first portion 40, a second portion 42 and a third portion 44, which may be arranged into a pattern. The first, second and third portions 40, 42, 44 are preferably sized and configured to increase the strength, rigidity, resilience and/or flexibility of the lip 22. For example, the first, second and third portions 40, 42, 44 may help support the outer surface of the lip 22. In particular, the first portion 40 may be generally spaced apart from the outer surface of the lip 32 a first distance; the second portion 42 may be generally spaced apart from the outer surface of the lip a second distance; and the third portion 44 may be generally spaced apart from the outer surface of the lip a third distance. The first, second and third distance are preferably different. For example, the first distance may be less than the second distance, and the second distance may be less than the third distance, which may form a pattern having an uneven configuration. Significantly, this may increase the strength, rigidity, resilience and/or flexibility of the lip 22 and/or the table top 12.

The lower surface 38 of the lip 22 may include a first portion 46 and a second portion 48, which may also be formed into a pattern. The first and second portions 46, 48 are preferably spaced apart from an opposing surface or portion of the table top 12, such as an upper surface of the table top. The first portion 46 may be generally spaced apart from the opposing surface a first distance; and the second portion 48 may be generally spaced apart from the opposing surface a second distance. Desirably, the first and second distances are different, such as the first distance being less than the second distance, which may form a pattern having an uneven configuration. Advantageously, this may increase the strength, rigidity, resilience and/or flexibility of the lip 22 and/or the table top 12.

Figure 6:
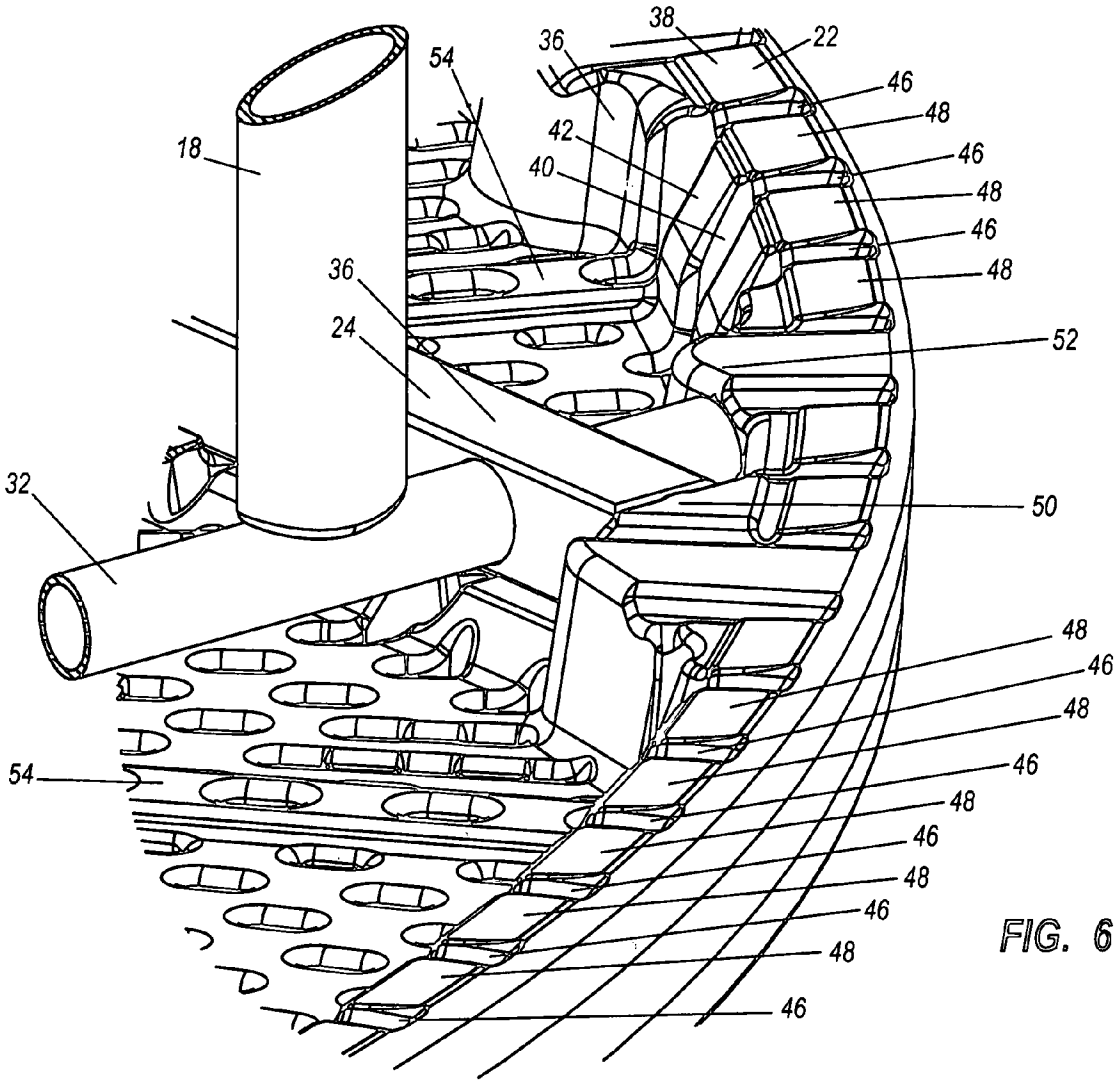
FIG. 6 is an enlarged view of still another portion of the table shown in FIG. 1.
Figure 7:
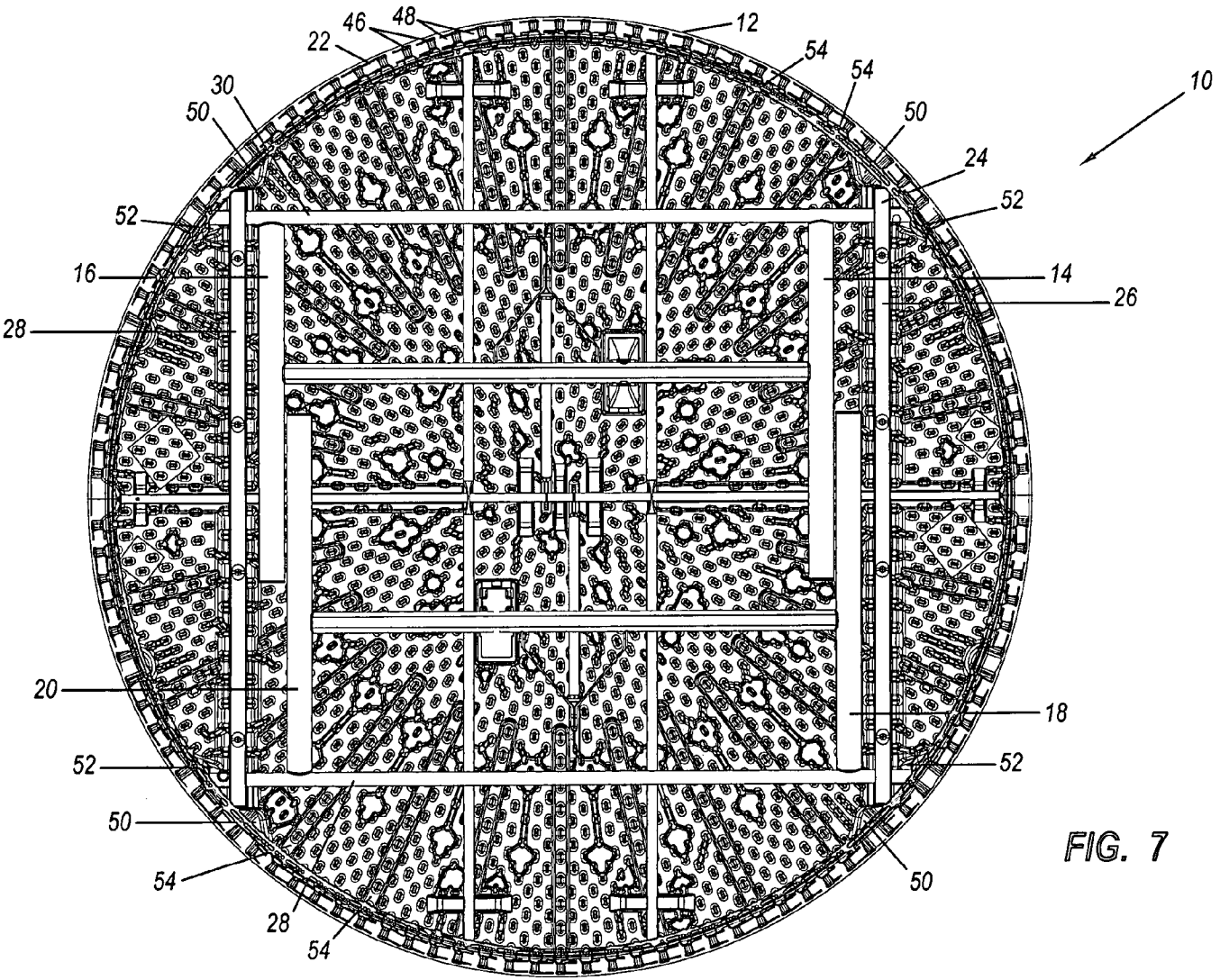
FIG. 7 is a bottom view of the table shown in FIG. 1, illustrating the legs in a collapsed or storage position.

As shown in FIG. 6, the portions first 46 may be spaced apart from an outer edge or perimeter of the table top 12. Spacing the first portions 46 from the outer edge may advantageously help prevent the first portions 46 from being seen from the side as shown in FIG. 2, which may provide a cleaner look for the table top 12. In addition, spacing the first portions 46 from the outer edge may help the table 10 to be more easily rolled upon the outer edge of the table top 12. It will be appreciated, however, that the first portions 46 may extend through the outer edge of the table top and/or may be visible from the side, if desired.

As shown in FIGS. 3-6, some or all of the first, second and third portions 40, 42, 44 of the inner surface 36 of the lip 22 may be generally aligned with some or all of the first and second portions 46, 48 of the lower surface 38 of the lip. This may advantageously help increase the strength, rigidity, resilience and/or flexibility of the lip 22 and/or the table top 12. In addition, the first portions 46 may be generally aligned with one or more depressions 34, which may also help increase the strength, rigidity, resilience and/or flexibility of the lip 22 and/or the table top 12.

The table top 12 may include one or more positioning members, which are preferably sized and configured to position portions of the table 10 in a desired location and/or orientation. For example, as shown in FIG. 6, the table top 12 may include first positioning members 50, which are preferably sized and configured to abut, contact and/or engage a portion of the frame 24, such as the rails 26, 28. In addition, the table top 12 may include second positioning members 52, which are preferably sized and configured to abut, contact and/or engage the cross members 30, 32. Advantageously, by abutting, contacting and/or engaging the cross members 30, 32 and/or the frame 26, the positioning members 50, 52 may advantageously help position the cross members and/or the frame in a desired location.

The table top 12 may include one or more elongated raised portions 54, which may be formed in a lower surface of the table top 12 and aligned with the lip 22. One or more depressions 34 may be at least partially disposed in the raised portions 54, if desired. In addition, the raised portions 54 and/or the depressions 34 may extend away from the lip 22 and toward a center portion of the table top 12, if desired. Preferably, the raised portions 54 and the depressions 34 are arranged into a predetermined pattern. For example, the raised portions 54 and the depressions 34 may be generally aligned with a radius or diameter of the table top 12. A pair of raised portions 54 may also extend toward each other and may be generally positioned along portions of the same diameter, for example, proximate opposing portions of the table top. It will be appreciated that the raised portions 54 and/or depressions 34 may have a variety of suitable configurations and arrangements depending, for example, upon the intended use of the table 10.

The table top 12 may include one or more elongated channels, which may be formed in a lower surface of the table top 12 and aligned with the lip 22. One or more depressions 34 may be at least partially disposed in the channels, and the channels and/or the depressions may extend away from the lip 22 and toward a center portion of the table top 12. The channels and/or the depressions 34 are preferably arranged into a predetermined pattern, such as being generally aligned with a radius or diameter of the table top 12. If desired, a pair of channels may extend toward each other and may be generally positioned along portions of a diameter, for example, proximate opposing portions of the table top. It will be appreciated that the channels and/or depressions may have other suitable configurations and arrangements depending, for example, upon the intended use of the table 10.

As shown in the accompanying figures, the depressions 34 preferably have a generally oblong configuration with generally linear sides and generally curvilinear ends. The depressions 34 may also have a generally rectangular configuration with rounded corners. Additionally, the generally oblong depressions 34 may have a generally oval configuration. It will be appreciated that the depressions 34 may also have other suitable shapes and configurations such as circular, non-circular and the like.

If the depressions 34 have a non-circular configuration, then each depression may have a first axis and a second axis. The first axis is preferably centrally located and may define a width of a depression, and the second axis may define a length of the depression. When the width of a depression is shorter than the length of the depression, the first axis may be referred to as the "minor axis" and the second axis may be referred to as the "major axis." When the width of a depression is longer than the length of the depression, the first axis may be referred to as the "major axis" and the second axis may be referred to as the "minor axis."

The depressions 34 preferably have generally the same size and configuration, which may allow various portions of the table to have generally the same characteristics. For example, the depressions may have a length of about one inch and a width of less than an inch, such as 0.5 inches. On the other hand, the length of the depressions 34 may be about 1.5 to 2.5 times the width of the depressions, if desired. It will be understood that the depressions 34 may be larger, smaller and/or have different shapes, sizes and configurations depending, for example, upon the intended use of the table 10. It will also be understood that different portions of the table top 12 may include depressions 34 with different shapes, sizes and configurations.

The shapes, sizes and configurations of the depressions 34 may help determine the characteristics of the depressions. For example, some depressions may have greater strength along a major axis and lesser strength along a minor axis. Accordingly, one or more depressions 34 may be positioned with their major axes generally aligned with a radius or diameter of the table top 12. This may leverage the greater strength associated with their major axes to increase the strength, rigidity, resilience and/or flexibility of the lip and/or the table top 12—which may advantageously help the lip and/or table top resist damage, for example, from storing the table top on its side or edges or from rolling the table along the table top's side or edge. Desirably, several sets of depressions 34 may be positioned with their major axes generally aligned with different radii or diameters of the table top 12, which may increase the strength, rigidity, resilience and/or flexibility of the table top and/or create a table top with generally uniform characteristics.

If the table top 12 has a generally circular configuration and the depressions 34 are generally aligned along a radius or diameter of the table top, then the depressions may be generally aligned in rows that are aligned with a center point of the table top 12. As the depressions 34 are positioned farther away from the center point of the table top 12, additional depressions may be added. Thus, the distance between adjacent depressions may be generally constant, which may also help create a table top with generally uniform characteristics.

It will be appreciated that the depressions 34 may have other suitable arrangements and configurations depending, for example, upon the intended use of the table 10. For example, the table top 12 may include sets of depressions 34 that are positioned with their major axes generally aligned with at least a portion of a line perpendicular to a tangent of the generally circular table top. This may advantageously leverage the greater strength associated with the major axes of the depressions 34 to help increase the strength, rigidity, resilience and/or flexibility of the lip 22 and/or the table top 12

Advantageously, the depressions 34 may be sized and configured to assist, support and/or cooperate with the reinforcement portions to help increase the strength, rigidity, resilience and/or flexibility of the table top 12. For example, depressions 34 may be sized and configured to have different characteristics in different directions. In particular, the depressions 34 may be sized and configured to have increased strength relative to the length of the depressions. Thus, when a plurality of depressions 34 are aligned or arranged into a pattern, these desired characteristics may be used to create a table top 12 with improved characteristics.

The desired characteristics of the depressions 34 may also be used in conjunction with other portions of the table 10, such as the reinforcement portions, to help increase the strength, rigidity, resilience and/or flexibility of the table top 12. Significantly, because the reinforcement portions may also have different characteristics in different directions, the desired characteristics of the reinforcement portions may be used in combination with the desired characteristics of the depressions to create a stronger, more rigid, more resilient and/or table top 12 with more flexibility. Thus, for example, if the depressions 34 have increased strength in one direction and the reinforcement portions have increased in one direction, then the depressions and reinforcement portions may be arranged to maximize the strength of the table top 12. On the other hand, depressions 34 and reinforcement portions may be arranged so that various portions of the table top 12 have generally the same strength. Advantageously, the depressions 34, reinforcement portions and/or other portions of the table 10 may be sized and configured to strength particular portions of the table top 12, such as the lip 22, and/or create a table top with generally uniform characteristics.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a table top including an upper surface, a lower surface and a hollow interior portion that are integrally formed as part of a unitary, one-piece structure;

at least one leg attached to the table top;

a lip downwardly extending from the table top, the lip including an inner portion that is disposed towards an inner portion of the table top, an outer portion that is disposed away from the inner portion of the table top, and a lower portion that is spaced apart from the lower surface of the table top by a distance, the inner portion, the outer portion and the lower portion defining three different portions of the lip, the lip being integrally formed with the table top during the blow-molding process as part of the unitary, one-piece structure; and one or more strengthening members integrally formed in the lower portion of the lip, the strengthening members being integrally formed with the table top as part of the unitary, one-piece structure, the strengthening members being sized and configured to increase the strength of the lip.

2. The table as in claim 1, wherein the strengthening members include a first portion formed in the lower portion of the lip and a second portion formed in the inner portion of the lip.

3. The table as in claim 1, further comprising a plurality of depressions integrally formed in the table top as part of the unitary, one-piece structure, the plurality of depressions including a major axis and a minor axis, at least one of the strengthening members being generally aligned with an axis of at least one of the plurality of depressions.

4. The table as in claim 1, wherein one or more of the strengthening members include one or more of inwardly extending portions.

5. The table as in claim 1, wherein the strengthening members formed in the lower portion of the lip include an end that is spaced apart from the outer portion of the lip.

6. The table as in claim 1, wherein the strengthening members include one or more outwardly extending portions.

7. The table as in claim 1, wherein the strengthening members include one or more inwardly extending portions and one or more outwardly extending portions.

8. The table as in claim 1, further comprising a plurality of positioning members that are sized and configured to help position at least a portion of a frame relative to the table top, the positioning members extending inwardly from the inner surface of the lip, the positioning members including an engagement surface that is sized and configured to engage a portion of the frame.

9. The table as in claim 1, wherein at least a substantial portion of the strengthening members are spaced apart by a generally constant distance.

10. The table as in claim 9, further comprising a plurality of depressions integrally formed in the lower portion of the table top as part of the unitary, one-piece structure, at least a portion of one of the plurality of depressions being at least partially disposed within one of the strengthening members.

11. A table comprising:

a table top constructed from blow-molded plastic, the table top including an upper portion, a lower portion and a hollow interior portion that are integrally formed during the blow-molding process;

at least one leg attached to the table top;

a lip including an outer portion that is disposed away from an inner portion of the table top, a lower portion that is spaced apart from the lower portion of the table top by a distance and an inner portion that is disposed towards the inner portion of the table top, the outer portion, the lower portion and the inner portion defining three different portions of the lip, the lip being integrally formed with the table top as part of the unitary, one-piece structure; and a plurality of reinforcement portions integrally formed in the lip as part of the unitary, one-piece structure, the reinforcement portions being sized and configured to increase the strength of the lip, the reinforcement portions including an inwardly extending portion formed in the lower portion of the lip.

12. The table as in claim 11, wherein the inwardly extending portion includes an end that is spaced apart from the outer portion of the lip.

13. The table as in claim 11, further comprising a plurality of depressions integrally formed in the table top as part of the unitary, one-piece structure construction, the plurality of depressions being arranged into a predetermined pattern in which one or more of the depressions are generally aligned along an axis, at least one of the plurality of reinforcement portions being generally aligned with the axis.

14. The table as in claim 11, further comprising a plurality of depressions formed in the lower portion of the table top, each of the plurality of depressions including a major axis that is generally aligned with a center of the table top.

15. The table as in claim 11, wherein one or more of the reinforcement portions include one or more outwardly extending portions.

16. The table as in claim 11, wherein the reinforcement portions are spaced apart by a generally constant distance.

17. The table as in claim 11, wherein the reinforcement portions include an inwardly extending portion formed in the inner portion of the lip, the inwardly extending portion in the lower portion of the lip being generally aligned with the inwardly extending portion in the inner portion of the lip.

18. The table as in claim 11 further comprising a plurality of depressions integrally formed in the lower portion of the table top as part of the unitary, one-piece structure, the plurality of depressions being arranged into a predetermined pattern that is sized and configured to support and increase the strength of the upper portion of the table top, at least a portion of one of the depressions being at least partially disposed in one of the reinforcement portions.

19. The table as in claim 11, further comprising a plurality of positioning members that are sized and configured to help position at least a portion of a frame relative to the table top, the positioning members extending inwardly from the inner surface of the lip, the positioning members including an engagement surface that is sized and configured to engage a portion of the frame.

20. An apparatus comprising:

at least a portion of a table top constructed from blow-molded plastic, the table top including an upper portion, a lower portion and a hollow interior portion that are formed as part of a unitary, one-piece structure during the blow-molding process;

a lip of the table top including an inner portion that is disposed towards an inner portion of the table top, a lower portion that is spaced apart from the lower portion of the table top by a distance and an outer portion that is disposed away from the inner portion of the table top, the inner portion, the lower portion and the outer portion forming three different portions of the lip, the lip being integrally formed with the table top as part of the unitary, one-piece structure during the blow-molding process;

a plurality of reinforcement portions at least partially formed in the lip, the reinforcement portions being integrally formed with the lip as part of the unitary, one-piece structure during the blow-molding process, the reinforcement portions being sized and configured to increase the strength of at least a substantial portion of the lip; and a plurality of depressions integrally formed in the lower portion of the table top as part of the unitary, one-piece structure during the blow-molding process, one or more of the depressions being generally aligned with one or more of the reinforcement portions.

21. The apparatus as in claim 20, wherein the table top has a round configuration and each of the depressions is generally disposed along an axis, the axis of each of the depressions being generally aligned with a center of the table top.

22. The apparatus as in claim 20, wherein the reinforcement portions include an inwardly extending portion formed in the lower portion of the lip and an inwardly extending portion formed in the inner portion of the lip.

23. The apparatus as in claim 20, wherein the reinforcement portions include an inwardly extending portion formed in the lower portion of the lip and an outwardly extending portion formed in the inner portion of the lip.

24. The apparatus as in claim 20, further comprising a pair of positioning members that are sized and configured to help position at least a portion of a frame relative to the table top, each of the positioning members extending inwardly from the inner surface of the tip, each of the positioning members including an engagement surface that is sized and configured to engage a portion of the frame.

25. The table as in claim 20, further comprising a plurality of positioning members that are sized and configured to help position at least a portion of a frame relative to the table top, the positioning members extending inwardly from the inner surface of the lip, the positioning members including an engagement surface that is sized and configured to engage a portion of the frame.

* * * * *

UNITED STATES PATENT AND TRADEMARK OFFICE

CERTIFICATE OF CORRECTION

PATENT NO. : 7,814,844 B2
APPLICATION NO. : 11/373582
DATED : October 19, 2010
INVENTOR(S) : Haney et al.

It is certified that error appears in the above-identified patent and that said Letters Patent is hereby corrected as shown below:

On the Face Page, in Field (75), under "Inventors", in Column 1, Line 1, delete "Thayne Haney," and insert -- Thayne B. Haney, --, therefor.

In Column 1, Line 53, delete "they w allow" and insert -- they allow --, therefor.

In Column 7, Line 26, delete "constructed" and insert -- constructed. --, therefor.

In Column 10, Line 42, delete "12" and insert -- 12. --, therefor.

In Column 14, Line 18, in Claim 25, delete "table" and insert -- apparatus --, therefor.

Signed and Sealed this
Eleventh Day of September, 2012

David J. Kappos

David J. Kappos
*Director of the United States Patent and Trademark Office*